US009353597B2

(12) United States Patent
Dotson et al.

(10) Patent No.: US 9,353,597 B2
(45) Date of Patent: May 31, 2016

(54) APPARATUS AND METHOD FOR ISOLATING FLOW IN A DOWNHOLE TOOL ASSEMBLY

(75) Inventors: Thomas L. Dotson, Woodburn, KY (US); Barrett Tucker, La Vernia, TX (US)

(73) Assignee: TD TOOLS, INC., Woodburn, KY (US)

( * ) Notice: Subject to any disclaimer, the term of this patent is extended or adjusted under 35 U.S.C. 154(b) by 529 days.

(21) Appl. No.: 13/506,601

(22) Filed: Apr. 30, 2012

(65) Prior Publication Data

US 2014/0069648 A1 Mar. 13, 2014

(51) Int. Cl.

| | |
|---|---|
| ***E21B 34/06*** | (2006.01) |
| ***E21B 43/114*** | (2006.01) |
| ***E21B 21/10*** | (2006.01) |

(52) U.S. Cl.

CPC ..... *E21B 34/06* (2013.01); *E21B 21/103* (2013.01); *E21B 43/114* (2013.01)

(58) Field of Classification Search

CPC ..... E21B 21/103; E21B 34/06; E21B 34/10; E21B 43/114

See application file for complete search history.

(56) References Cited

U.S. PATENT DOCUMENTS

| | | | | |
|---|---|---|---|---|
| 3,066,735 | A | 12/1962 | Zingg | |
| 3,130,786 | A | 4/1964 | Brown et al. | |
| 3,266,571 | A | 8/1966 | St. John et al. | |
| 5,533,571 | A | 7/1996 | Surjaatmadja et al. | |
| 5,566,762 | A * | 10/1996 | Braddick et al. | 166/382 |
| 6,085,843 | A | 7/2000 | Edwards et al. | |
| 7,096,954 | B2 * | 8/2006 | Weng et al. | 166/308.1 |
| 7,383,881 | B2 * | 6/2008 | Telfer | 166/212 |
| 7,500,526 | B2 * | 3/2009 | Telfer | 166/387 |
| 8,066,059 | B2 | 11/2011 | Ferguson et al. | |
| 8,783,365 | B2 * | 7/2014 | McCoy | E21B 34/14 166/318 |
| 2012/0018142 | A1 * | 1/2012 | Spence | 166/77.1 |
| 2012/0224985 | A1 * | 9/2012 | Forsberg | 417/410.1 |

OTHER PUBLICATIONS

J.S.Cobbett, "Sand jet perforating revisited", SPE 55044, SPE Drill. & Completion, vol. 14, No. 1, Mar. 1999, p. 28-33.

* cited by examiner

*Primary Examiner* — William P Neuder

(74) *Attorney, Agent, or Firm* — Norton Rose Fulbright US LLP

(57) ABSTRACT

An apparatus for isolating fluid flow in a bottomhole tool assembly comprises a generally cylindrically shaped flow tube with a side, a top, and a bottom; an upper ball seat connected to the top of the flow tube; a lower ball seat connected to the bottom of the flow tube; a plurality of openings in the side of the flow tube; a tapered inner diameter in the upper ball seat, acting as a ball valve; a tapered inner diameter in the lower ball seat, acting as a ball valve, smaller than the tapered inner diameter in the upper ball seat; an upper sub attached to the bottomhole tool assembly; a lower sub attached to the bottomhole tool assembly; shear pins connecting the upper ball seat to the upper sub; and a limiting pin in the lower sub below the lower ball assembly.

23 Claims, 4 Drawing Sheets

APPARATUS AND METHOD FOR ISOLATING FLOW IN A DOWNHOLE TOOL ASSEMBLY

CROSS-REFERENCES TO RELATED APPLICATIONS

Not Applicable

FEDERALLY SPONSORED RESEARCH OR DEVELOPMENT

Not Applicable

SEQUENCE LISTING, TABLE, OR COMPUTER LISTING

Not Applicable

BACKGROUND OF THE INVENTION

1. Field of the Invention

This invention relates generally to the field of treating wells to stimulate fluid production. More particularly, the invention relates to the field of combining the use of downhole tools with the use of abrasive jet perforating tools in a single trip in a well.

2. Description of the Related Art

Abrasive jet perforating uses fluid slurry pumped under high pressure to perforate tubular goods around a wellbore, where the tubular goods include tubing, casing, and cement. Since sand is the most common abrasive used, this technique is also known as sand jet perforating (SJP). Abrasive jet perforating was originally used to extend a cavity into the surrounding reservoir to stimulate fluid production. It was soon discovered, however, that abrasive jet perforating could not only perforate, but cut (completely sever) the tubular goods into two pieces. Sand laden fluids were first used to cut well casing in 1939. Abrasive jet perforating was eventually attempted on a commercial scale in the 1960s. While abrasive jet perforating was a technical success (over 5,000 wells were treated), it was not an economic success. The tool life in abrasive jet perforating was measured in only minutes and fluid pressures high enough to cut casing were difficult to maintain with pumps available at the time. A competing technology, explosive shape charge perforators, emerged at this time and offered less expensive perforating options.

Consequently, very little work was performed with abrasive jet perforating technology until the late 1990's. Then, more abrasive-resistant materials used in the construction of the perforating tools and jet orifices provided longer tool life, measured in hours or days instead of minutes. Also, advancements in pump materials and technology enabled pumps to handle the abrasive fluids under high pressures for longer periods of time. The combination of these advances made the abrasive jet perforating process more cost effective. Additionally, the recent use of coiled tubing to convey the abrasive jet perforating tool down a wellbore has led to reduced run time at greater depth. Further, abrasive jet perforating did not require explosives and thus avoids the accompanying danger involved in the storage, transport, and use of explosives. However, the basic design of abrasive jet perforating tools used today has not changed significantly from those used in the 1960's.

Abrasive jet perforating tools and casing cutters were initially designed and built in the 1960's. There were many variables involved in the design of these tools. Some tool designs varied the number of jet locations on the tool body, from as few as two jets to as many as 12 jets. The tool designs also varied the placement of those jets, such, for example, positioning two opposing jets spaced 180° apart on the same horizontal plane, three jets spaced 120° apart on the same horizontal plane, or three jets offset vertically by 30°. Other tool designs manipulated the jet by orienting it at an angle other than perpendicular to the casing or by allowing the jet to move toward the casing when fluid pressure was applied to the tool.

As abrasive jet perforating use increases, the desire to combine it with other steps in the well completion, stimulation, and intervention processes also increase. Having the ability to selectively close flow below a tool like an abrasive jet perforator, perform perforations, then resume flow through that section of the bottomhole tool assembly allows other tasks like milling to be performed while also completing the abrasive jet perforating job in the same trip. This combination reduces the number of trips in and out of the well, which, in turn lowers completion costs.

The following patents and publications are representative of conventional abrasive jet perforating tools, along with apparatuses and methods that may be employed with the tools.

U.S. Pat. No. 3,066,735 by Zingg, "Hydraulic Jetting Tool", discloses the use of drop balls and a sliding cylinder or sleeve to block jet orifices and to switch fluid flow between jets in an abrasive jet perforating tool.

U.S. Pat. No. 3,130,786, by Brown et al., "Perforating Apparatus", discloses sealing off the bottom of the abrasive jet perforating tool with a ball valve to allow pressure to increase for the abrasive jet perforating job.

U.S. Pat. No. 3,266,571 by St. John et al., "Casing Slotting" discloses an abrasive jet perforating tool designed to cut slots of controlled length. The slot lengths are controlled by abrasive resistant shields attached to the tool to block the flow from rotating abrasive jets.

U.S. Pat. No. 5,533,571 by Surjaatmadj a et al., "Surface Switchable Down-Jet/Side-Jet Apparatus", discloses a sliding valve sleeve activated by a dropped ball that, when pressure is applied, forces the valve sleeve to shear a shear pin. In a first position, jetting is out a longitudinally directed port. In a second position, jetting is out a transverse port.

U.S. Pat. No. 6,085,843 by Edwards et al., "Mechanical Shut-Off Valve", discloses a shut-off valve connecting adjacent tools in a downhole string, permitting or blocking hydraulic or ballistic communication.

U.S. Pat. No. 8,066,059 B2, by Ferguson et al., "Method and Devices for One Trip Plugging and Perforating of Oil and Gas Wells", discloses an abrasive jet perforating tool that uses sliding sleeves to permit fluid flow through the perforating tool to a bridge plug. Setting the bridge plug directs abrasive fluid flow to the perforating orifices.

An SPE publication by J. S. Cobbett, "Sand Jet Perforating Revisited", SPE 55044, SPE Drill. & Completion, Vol. 14, No. 1, p. 28-33, March 1999, discloses the use of sand jet perforating (abrasive jet perforating) with coiled tubing to increase production in damaged wells, using examples of neglected wells in Lithuania.

Thus, a need exists for a flow isolation tool assembly and a method of use that allows fluid flow through an inner diameter of an assembly of downhole tools in a well, then selectively blocks the fluid flow at a desired location in the assembly of tools, and finally allows re-establishment of fluid flow through the tools again after the desired task is complete.

BRIEF SUMMARY OF THE INVENTION

The invention is an apparatus and a method for isolating fluid flow in a bottomhole tool assembly in wells. In one embodiment, the invention is an apparatus for isolating fluid flow in a bottomhole tool assembly that comprises a generally cylindrically shaped flow tube with a side, a top, and a bottom; an upper ball seat connected to the top of the flow tube; a lower ball seat connected to the bottom of the flow tube; a plurality of openings in the side of the flow tube; a tapered inner diameter in the upper ball seat, acting as a ball valve; a tapered inner diameter in the lower ball seat, acting as a ball valve, smaller than the tapered inner diameter in the upper ball seat; an upper sub attached to the bottomhole tool assembly; a lower sub attached to the bottomhole tool assembly; shear pins connecting the upper ball seat to the upper sub; and a limiting pin in the lower sub below the lower ball assembly.

In another embodiment, the invention is a method for isolating fluid flow in a bottomhole tool assembly. A tool is configured in an initial tool setup which allows fluid to flow through the bottomhole tool assembly. A smaller ball is pumped into the fluid stream of the well, after the initial downhole job is complete. Abrasive fluid is pumped through the tubing. A larger ball is pumped down to the tool, after the perforating job is complete. The tube/seat assembly in the flow isolation tube assembly is shifted downward until the bottom of the lower ball seat is resting on the limit pin. An additional downhole job is completed with the bottomhole tool assembly.

BRIEF DESCRIPTION OF THE DRAWINGS

The invention and its advantages may be more easily understood by reference to the following detailed description and the attached drawings, in which.

While the invention will be described in connection with its preferred embodiments, it will be understood that the invention is not limited to these. On the contrary, the invention is intended to cover all alternatives, modifications, and equivalents that may be included within the scope of the invention, as defined by the appended claims.

DETAILED DESCRIPTION OF THE INVENTION

The invention is an apparatus, a flow isolation tool assembly, and a method for using this flow isolation tool assembly in a well. The invention allows fluid flow through an inner diameter of an assembly of downhole tools in a well, then selectively blocks the fluid flow at a desired location in the assembly of tools, and finally allows re-establishment of fluid flow through the tools again after the desired task is complete. In a preferred embodiment, the invention is used with an abrasive jet perforating tool in wells, but the invention is not limited to this use. The invention could be used in other oilfield related bottomhole tool assemblies in which fluid flow diversion or isolation is desired. Use of this flow isolation tool assembly allows for multiple tasks to be accomplished in one trip down the well.

Figure 1:
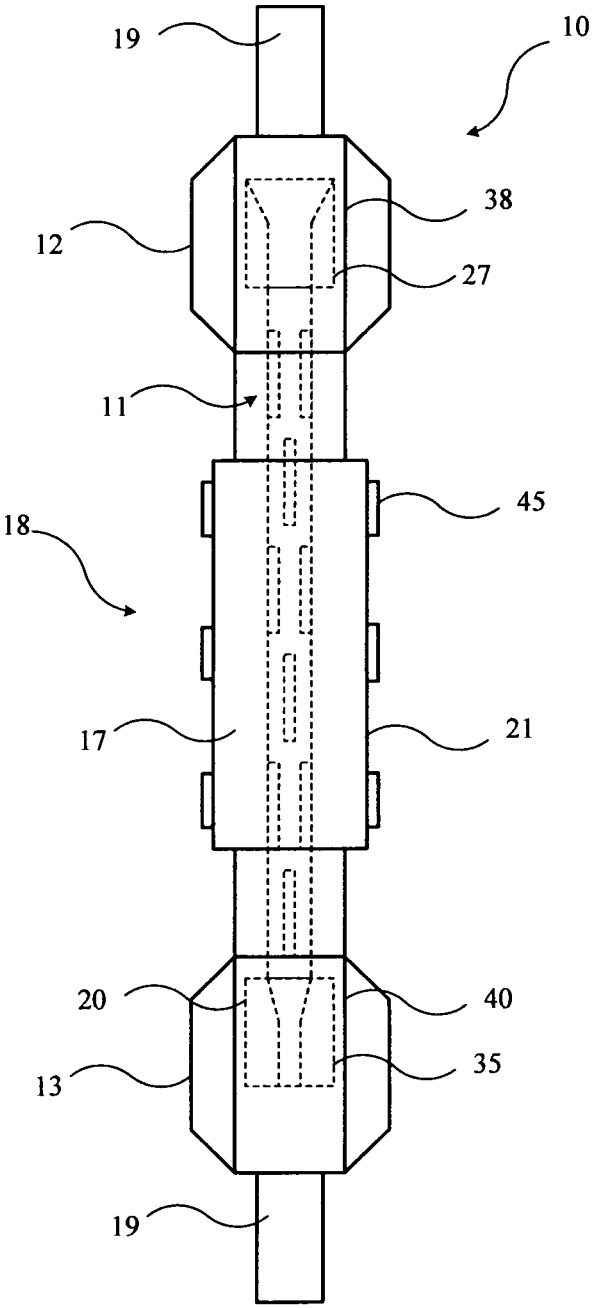
FIG. 1 shows a schematic side view of an embodiment of a flow isolation tool assembly of the invention.

FIG. 1 shows a schematic side view (not necessarily to scale) of an embodiment of the flow isolation tool assembly of the invention. FIG. 1 shows a basic embodiment of the flow isolation tool assembly.

Figure 2:
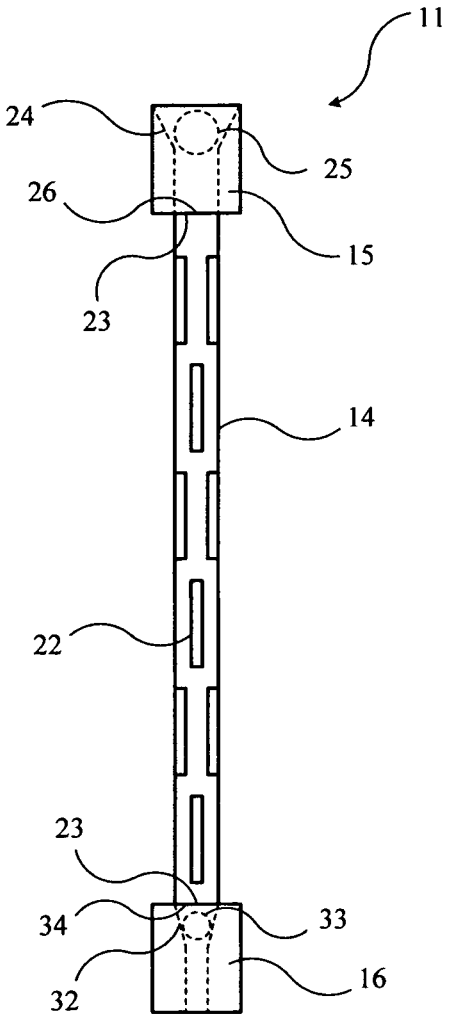
FIG. 2 shows a schematic side view of an embodiment of a tube/seat assembly of the invention corresponding to the flow isolation tool assembly in FIG. 1.

In FIG. 1, the flow isolation tool assembly is generally designated as 10. The flow isolation tool assembly 10 generally comprises a tube/seat assembly 11, an upper sub 12, and a lower sub 13. FIG. 2 shows a schematic side view (not necessarily to scale) of an embodiment of the tube/seat assembly corresponding to the flow isolation tool assembly in FIG. 1. The tube/seat assembly 11 comprises a flow tube 14, an upper ball seat 15, and a lower ball seat 16. Each of these elements in the flow isolation tool assembly 10 will be described in more detail below.

Figure 3:
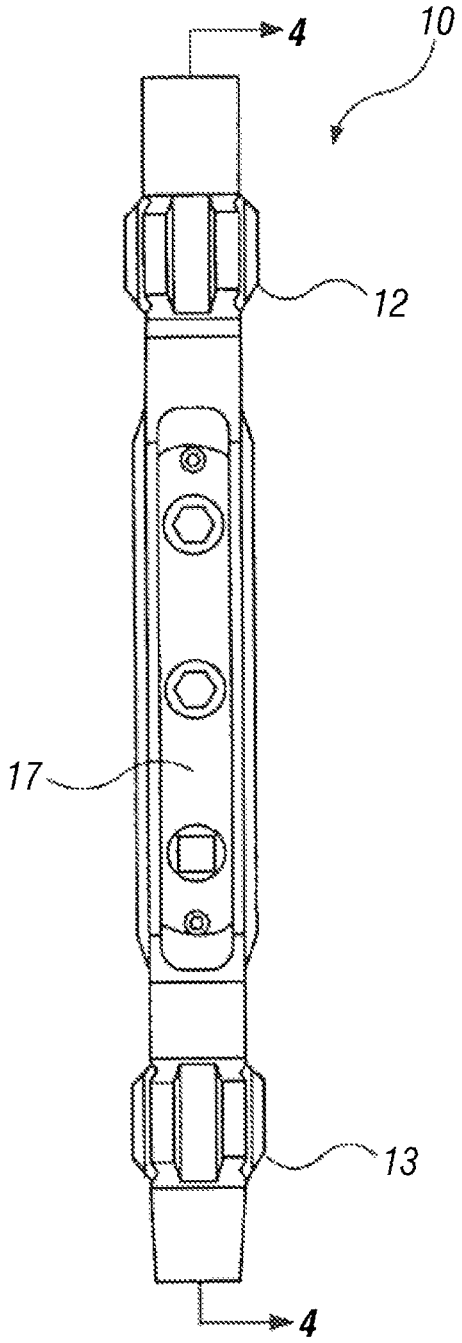
FIG. 3 shows a side view of an embodiment of the flow isolation tool assembly.
Figure 4:
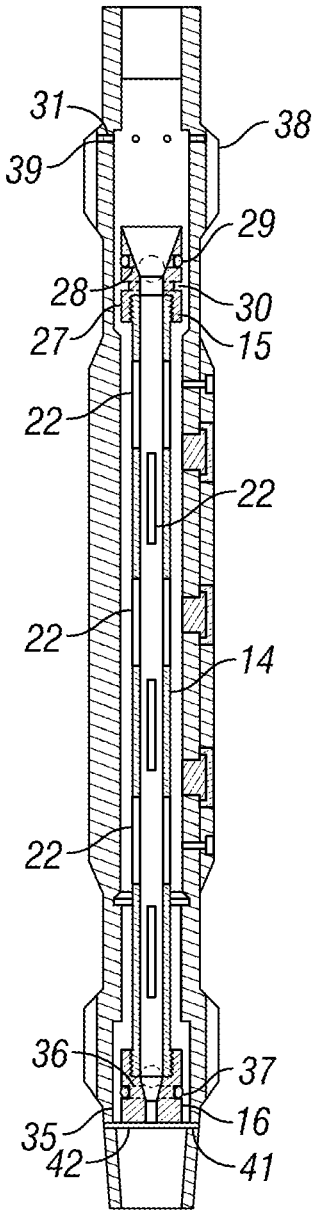
FIG. 4 shows a cross-sectional view of the flow isolation tool assembly along the line 4-4 in FIG. 3.

FIG. 3 shows a side view of an embodiment of the flow isolation tool assembly. FIG. 4 shows a cross-sectional view of the flow isolation tool assembly along the line 4-4 in FIG. 3.

Returning to FIG. 1, the tube/seat assembly 11 is located inside a tool 17 in a bottomhole tool assembly 18 suspended by tubing 19 in a wellbore (not shown). The type of tool 17 being employed is not a limitation of the invention. In FIG. 1, the tool 17 is illustrated as an abrasive jet perforator, but any appropriate downhole tool is covered by the invention. The outer diameter 20 of the tube/seat assembly 11 is an appropriate size to fit inside the inner diameter 21 of the tools 17 employed in the bottomhole tool assembly 18.

Returning to FIG. 2, the flow tube 14 is a generally cylindrically shaped tube. The flow tube 14 has openings 22, such as, for example, holes or slots, cut in a direction perpendicular to the length (longitudinal axis) of the flow tube 14. The flow tube 14 has means 23, such as, for example, threads, to connect the flow tube 14 to ball seats on each end.

Returning to FIG. 1, an upper ball seat 15 is connected to the top of the flow tube 14. The upper ball seat 15 contains a tapered inner diameter 24 to act as a ball valve and allow a larger ball 25 to seal off and prevent fluid flow from passing by the larger ball 25 when engaged. The lower portion of the upper ball seat 15 inner diameter 24 has means 26, such as, for example, threads, to connect the upper ball seat 15 to the top of the flow tube 14. The outer diameter 27 of the upper ball seat 15 has grooves 28 for seals 29 (shown in FIG. 4). The seals 29 may be any appropriate means for sealing, such as, for example, O-rings. The outer diameter 27 of the upper ball seat 15 also has a groove 30 to accept shear pins 31 to hold the upper ball seat 15 in place (shown in FIG. 4).

Returning to FIG. 2, a lower ball seat 16 is connected to the bottom of the flow tube 14. The lower ball seat 16 contains a smaller tapered inner diameter 32 to act as a ball valve and allow a smaller sized ball 33 to seal off and prevent fluid flow from passing by the ball 33 when engaged. The upper portion of the lower ball seat 16 inner diameter 34 has means, such as, for example, threads, to connect the lower ball seat 16 to the bottom of the flow tube 14 (shown in FIG. 4). The outer diameter 35 of the lower ball seat 16 has grooves 36 for seals 37 (shown in FIG. 4). The seals 37 may be any appropriate means for sealing, such as, for example, O-rings.

Returning to FIG. 1, an upper sub 12 is attached to the bottomhole tool assembly 18 and acts as a centralizer for the bottomhole tool assembly 18. The upper sub 12 (as well as the lower sub 13, discussed below) is a short tool section. The inner diameter 38 of the upper sub 12 is shaped to have a close tolerance to the outer diameter 27 of the upper ball seat 15 and then a larger inner diameter 38 to allow fluid flow around the upper ball seat 15 after the bottomhole tool assembly 18 has shifted down. The upper sub 12 has threaded holes 39 for the shear pins 31 that hold the upper ball seat 15 in place (shown in FIG. 4).

A lower sub 13 is attached to the bottomhole tool assembly 18 and also acts as a centralizer for the bottomhole tool assembly 18. The inner diameter 40 of the lower sub 13 is shaped to have a close tolerance to the outer diameter 35 of the lower ball seat 16 and then a larger inner diameter 40 to allow fluid flow around the lower ball seat 16 after the bottomhole tool assembly 18 has shifted down. The lower sub 13 has holes 41 for a limit pin 42 that installs perpendicular to the length (longitudinal axis) of the lower sub 13 below the lower ball seat 16 to limit the downward movement of the tube/seat assembly 11.

Figure 5:
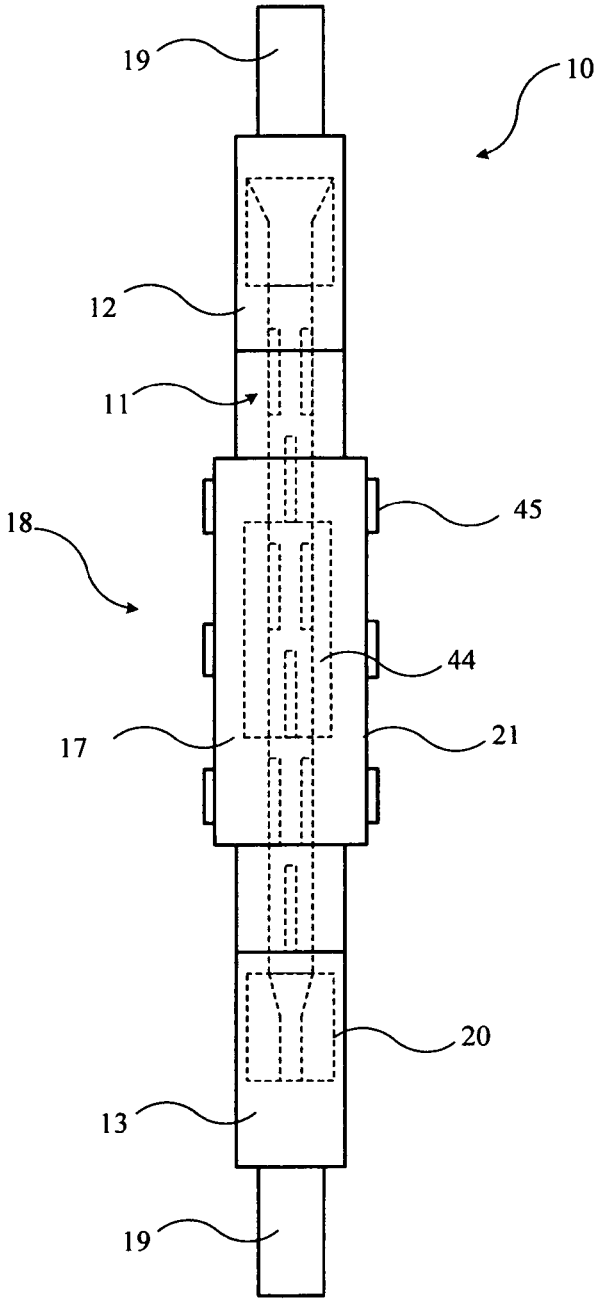
FIG. 5 shows a side view of an alternate embodiment of the flow isolation tool assembly.
Figure 6:
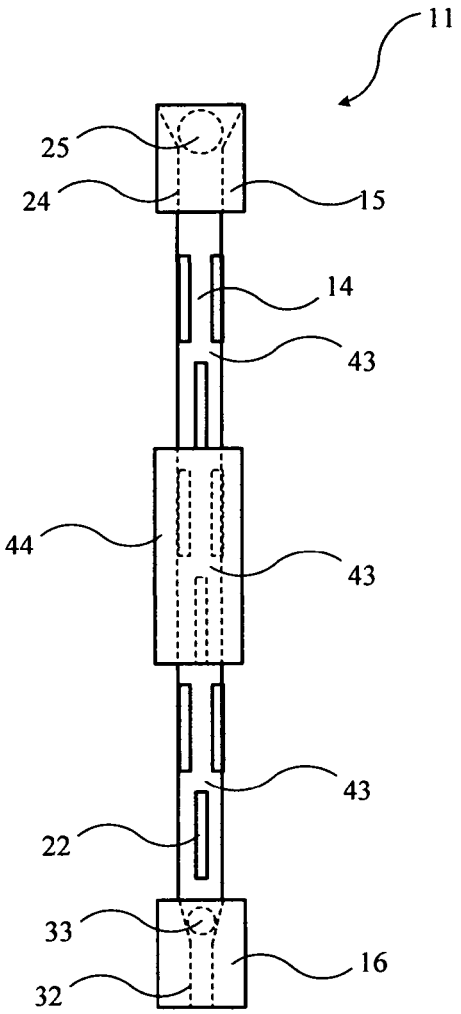
FIG. 6 shows a side view of an alternate embodiment of the tool/seat assembly corresponding to the flow isolation tool assembly in FIG. 5.

FIG. 5 shows a side view of an alternate embodiment of the flow isolation tool assembly. FIG. 6 shows a side view of an alternate embodiment of the tool/seat assembly corresponding to the flow isolation tool assembly in FIG. 5.

Depending on the particular application, alternate embodiments may use one or more variations to this basic configuration. These variations include, but are not limited to, the following.

The outer diameter 27 of the upper ball seat 15 may have multiple grooves 28 for additional seals 29, such as, for example, O-rings (not shown). Similarly, the outer diameter 34 of the lower ball seat 16 may have multiple grooves for additional seals, such as, for example, O-rings (not shown).

In addition to the upper ball seat 15 and the upper sub 12, the lower ball seat 16 and the lower sub 13 may also contain shear pins to provide additional support for the bottomhole tool assembly 18 (not shown).

Referring to FIGS. 5 and 6, the flow tube 14 may comprise multiple pieces 43 with sleeves 44 connecting between. The sleeves 44 are employed to block or open fluid flow to various ports 45 on the tool 17. In addition, the upper sub 12 and the lower sub 13 may have a reduced outer diameter which does not function as a centralizer.

Figure 7:
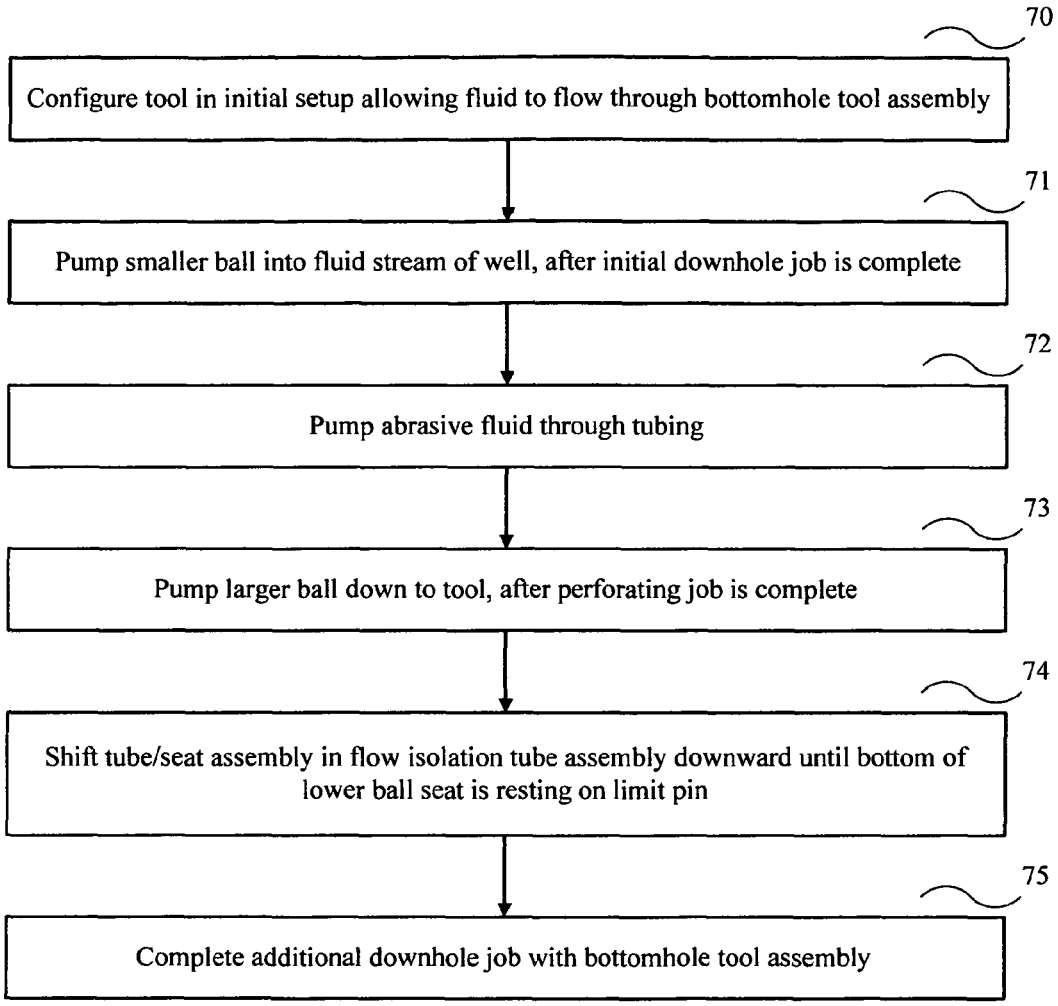
FIG. 7 is a flowchart illustrating an embodiment of the method of the invention for isolating fluid flow in a bottomhole tool assembly.

In another embodiment, the invention is a method for performing well jobs with bottomhole tool assemblies. The embodiment is illustrated with an abrasive jet perforating tool as the bottomhole tool assembly. However, the method of the invention is not limited by this choice of tool. FIG. 7 is a flowchart illustrating an embodiment of the method of the invention for isolating fluid flow in a bottomhole tool assembly.

At block 70, a tool is configured in an initial tool setup which allows fluid to flow through the bottomhole tool assembly 18 so that the fluid is used to perform a downhole job. The job could be, by way of example but not restriction, to clean the well or operate a mud motor.

At block 71, a smaller ball 33 is pumped into the fluid stream of the well, after the initial job is complete. The smaller ball 33 seats in the lower ball seat 16 and blocks fluid flow through the bottomhole tool assembly 18. In a preferred embodiment (the prototype), a ⅝" ball is used for the smaller ball 16.

At block 72, abrasive fluid is pumped through the tubing 19. Pressure inside the tool 17 builds to levels controlled by the abrasive perforating jets 45 (orifice size and pump flow rate) and abrasive jet perforations are made in the wellbore.

At block 73, a larger ball 25 is pumped down to the tool 17, after the perforating job is complete. The larger ball 25 seats in the upper ball seat 15 and blocks all flow through the abrasive jet perforating tool 17. In a preferred embodiment (the prototype), a ¾" ball is used for the larger ball 25. As pumping continues, pressure increases until the shear pins 31 supporting the upper ball seat 15 are severed.

At block 74, the tube/seat assembly 11 in the flow isolation tube assembly 10 shifts downward until the bottom of the lower ball seat 16 is resting on the limit pin 42. Fluid flow then passes around the upper ball seat 15 and the lower ball seat 16, which are now in a larger inner diameter portion of the upper sub 12 and the lower sub 13, and continues through the tool 17.

At block 75, an additional job can now be completed with the bottomhole tool assembly 18. The additional job could be, by way of example but not restriction, cleaning sand and other well debris or milling. Further, the method of the invention includes performing the additional job as the bottomhole tool assembly 18 is pulled out of the well.

The flow isolation tube assembly described above has numerous advantages. It allows for flow through the tool assembly both before and after the perforating operation. This results in fewer trips downhole. Thus, overall time to complete the required work is reduced, which reduces the cost. The flow isolation tube assembly may not even touch the tool that it runs through, allowing for unobstructed operation. Different types and configurations of abrasive jet perforators and other tools can be run with no or only slight modification to the system.

It should be understood that the preceding is merely a detailed description of specific embodiments of this invention and that numerous changes, modifications, and alternatives to the disclosed embodiments can be made in accordance with the disclosure here without departing from the scope of the invention. The preceding description, therefore, is not meant to limit the scope of the invention. Rather, the scope of the invention is to be determined only by the appended claims and their equivalents.

We claim:

1. An apparatus for isolating fluid flow in a bottomhole tool assembly, comprising:

a generally cylindrically shaped flow tube with a side, a top, and a bottom;

an upper ball seat connected to the top of the flow tube;

a lower ball seat connected to the bottom of the flow tube, wherein a tube/seat assembly comprising the connected flow tube, upper ball seat, and lower ball seat is located inside an abrasive jet tubular goods perforating tool in the bottomhole tool assembly, and configured to shift down;

a plurality of openings in the side of the flow tube;

a tapered inner diameter in the upper ball seat, acting as a ball valve;

a tapered inner diameter in the lower ball seat, acting as a ball valve, smaller than the tapered inner diameter in the upper ball seat;

an upper sub attached to the bottomhole tool assembly;

a lower sub attached to the bottomhole tool assembly;

at least one shear pin configured to perform at least one of: connecting the upper ball seat to the upper sub, and connecting the lower ball seat to the lower sub.

2. The apparatus of claim 1, wherein an outer diameter of the tube/seat assembly has an appropriate size to fit inside an inner diameter of the tool.

3. The apparatus of claim 1, wherein the plurality of openings in the side of the flow tube are cut in a direction perpendicular to a length of the flow tube.

4. The apparatus of claim 1, wherein an outer diameter of the upper ball seat has at least one groove for at least one seal.

5. The apparatus of claim 4, wherein the at least one seal is an O-ring.

6. The apparatus of claim 1, wherein an outer diameter of the upper ball seat has at least one groove to accept the at least one shear pin.

7. The apparatus of claim 1, wherein an outer diameter of the lower ball seat has at least one groove for at least one seal.

8. The apparatus of claim 7, wherein the at least one seal is an O-ring.

9. The apparatus of claim 1, wherein the upper sub acts as a centralizer for the bottomhole assembly.

10. The apparatus of claim 1, wherein the lower sub acts as a centralizer for the bottomhole assembly.

11. The apparatus of claim 1, further comprising:

an inner diameter of the lower sub has a close tolerance to an outer diameter of the lower ball seat; and an inner diameter of the lower sub is larger to allow fluid flow around the lower ball seat after the tube/seat assembly has shifted down.

12. The apparatus of claim 1, further comprising:

at least one threaded hole in the upper sub to hold the at least one shear pin.

13. The apparatus of claim 1, further comprising:

at least one hole in the lower sub to hold a limiting pin.

14. The apparatus of claim 1, further comprising:

multiple pieces of the flow tube; and at least one sleeve connecting the multiple pieces of the flow tube.

15. The apparatus of claim 14, wherein the at least one sleeve is employed to block or open fluid flow to ports on the tool.

16. The apparatus of claim 1, further comprising:

at least one shear pin connecting the lower ball seat to the lower sub.

17. The apparatus of claim 1, further comprising a limiting pin in the lower sub below the lower ball seat.

18. The apparatus of claim 1, further comprising:

an inner diameter of the upper sub has a close tolerance to an outer diameter of the upper ball seat; and an inner diameter of the upper sub larger to allow fluid flow around the upper ball seat after the bottomhole assembly has shifted down.

19. A method for isolating fluid flow in a bottomhole tool assembly, comprising:

configuring a tool in an initial tool setup which allows fluid to flow through the bottomhole tool assembly to perform a downhole task;

pumping a smaller ball into the fluid stream of a well, after the initial downhole task is complete;

pumping abrasive fluid through tubing;

pumping a larger ball down to the tool, after a perforating task is complete;

shifting a tube/seat assembly in a flow isolation tube assembly downward until the bottom of a lower ball seat is resting on a limit pin; and completing an additional downhole task with the bottomhole tool assembly.

20. The method of claim 19, wherein the step of pumping a smaller ball further comprises:

seating the smaller ball in the lower ball seat; and blocking fluid flow through the bottomhole tool assembly.

21. The method of claim 19, wherein the step of pumping abrasive fluid further comprises:

building pressure inside the tool to levels controlled by the abrasive perforating jets; and making abrasive jet perforations in the wellbore.

22. The method of claim 19, wherein the step of shifting the tube/seat assembly further comprises performing the additional downhole task as the bottomhole tool assembly is pulled out of the well.

23. The method of claim 19, wherein the step of completing an additional task further comprises passing fluid flow around the upper and lower ball seats and through the tool.

* * * * *